US008142256B2

(12) United States Patent
Rose et al.

(10) Patent No.: US 8,142,256 B2
(45) Date of Patent: Mar. 27, 2012

(54) BREAST SAVER: AN ERGONOMIC DYNAMIC BRA WITH COMBO CUPS

(75) Inventors: Cassandra Rose, Naples, FL (US); Heidi Lehmann, Stamford, CT (US)

(73) Assignee: VIBRANT, LLC, Milwaukee, WI (US)

( * ) Notice: Subject to any disclaimer, the term of this patent is extended or adjusted under 35 U.S.C. 154(b) by 294 days.

(21) Appl. No.: 12/384,410

(22) Filed: Apr. 3, 2009

(65) Prior Publication Data

US 2010/0255755 A1 Oct. 7, 2010

(51) Int. Cl.
*A41C 3/00* (2006.01)

(52) U.S. Cl. ..... 450/39; 450/92; 450/93

(58) Field of Classification Search ..... 450/36–39, 450/54–58, 92, 93, 86; 2/267, 268; 602/7, 602/8

See application file for complete search history.

(56) References Cited

U.S. PATENT DOCUMENTS

| | | | | |
|---|---|---|---|---|
| 4,127,128 | A * | 11/1978 | Schmidt | 450/1 |
| 5,944,578 | A | 8/1999 | Lin | 450/57 |
| 6,422,917 | B1 | 7/2002 | Rose | 450/65 |
| 6,796,876 | B2 | 9/2004 | Luk | 450/39 |
| 6,814,647 | B1 | 11/2004 | Huang | 450/39 |
| 6,921,316 | B1 | 7/2005 | Jian | 450/38 |
| 6,986,696 | B1 | 1/2006 | Jagaric | 450/39 |
| 7,198,540 | B2 | 4/2007 | Liu | 450/36 |
| 7,390,239 | B1 | 6/2008 | Huang | 450/39 |
| 7,429,205 | B1 | 9/2008 | Huang | 450/39 |
| 7,458,877 | B2 * | 12/2008 | Yu | 450/39 |
| 7,488,234 | B2 | 2/2009 | Rothman et al. | 450/36 |
| 2004/0029486 | A1 * | 2/2004 | Greter et al. | 450/39 |
| 2005/0085161 | A1 * | 4/2005 | Klakauskas | 450/57 |
| 2006/0094336 | A1 * | 5/2006 | Fildan et al. | 450/92 |
| 2006/0252346 | A1 * | 11/2006 | Reinisch et al. | 450/86 |
| 2008/0125012 | A1 * | 5/2008 | Gransberry | 450/64 |

* cited by examiner

*Primary Examiner* — Gloria Hale

(74) *Attorney, Agent, or Firm* — Rashida A. Karmali; Rashida A. Karmali, Esq.

(57) ABSTRACT

An ergonomically constructed dynamic bra includes smart combo cups designed with multilayered materials, a modern neckline silhouette, supporting armhole and a cut-out tear drop area to achieve a soft and quiet bust point. A sling is built into the cup for breast support, to construct different ergonomic, bra designs, including i) a semi-demi ergonomic bra design with or without straps, with a plunging neckline and including at the sides telescope boning, support frame and back strap ending in a soft-seal and cushioned back fastener, ii)—a full coverage ergonomic bra designed as the semi-demi ergonomic bra including a pair of pressure releasing cushioned front straps, and iii) a cross-over strap bra design including pressure releasing cushioned front straps designed to cross-over in -the back and fastened to the opposite side of a back frame. The ergonomic bra is constructed to facilitate interaction between the breasts and the body.

11 Claims, 4 Drawing Sheets

BREAST SAVER: AN ERGONOMIC DYNAMIC BRA WITH COMBO CUPS

1. FIELD OF INVENTION

This invention discloses an ergonomically constructed dynamic bra including smart combo cups to provide lift and projection naturally to the breast without causing compression, pressure or confinement and without use of under wires. More particularly, the present invention relates to i) smart combo cups designed with multilayered materials and cut to create a modern neckline silhouette, supporting armhole and a cut-out tear drop, or other shape such as circle or oval section in the bust point area, each of said smart cups built into a dynamic sling breast support, ii) a strapless ergonomic dynamic bra and a semi-demi ergonomic bra with straps, each including at the sides telescope boning, support side frame and back strap ending in a soft-seal and cushioned back fastener, with the semi-demi also having a plunging neckline and, iii) a full coverage ergonomic dynamic bra designed having more coverage, and a wider shoulder strap platform compared to the semi-demi compared to the semi-demi ergonomic dynamic bra, but including in addition a pair of pressure releasing cushioned front straps, and iv) an ergonomic dynamic full coverage cross-over strap bra design including pressure releasing cushioned front straps designed to cross-over in the small of the back and fastened to the opposite extended side of a tongue shaped back frame which is attached to the side of the support frame. The invention generally relates to smart bra cups built into a sling breast support that is further constructed into different embodiments of the ergonomic dynamic bra to facilitate continuous motion of the body and interaction between the breasts, the underlying chest muscles, the lateral muscles framing the breasts on each side and the back muscles, said dynamic motion resulting in breast support, firmness and comfort and a reduction in muscle pressure and tension in the upper body overall. The smart cups may be worn as unitary garments in addition to being built into the various designs of the ergonomic dynamic bra or other garments.

2. BACKGROUND TO THE INVENTION

There has been continuing interest in the apparel industry to develop bras that provide a supporting and lifting effect to the bust in front while ensuring proper overall breast and muscle health in the upper body. Women wear bras to protect the breasts and maintain the shape of the breasts. A good bra is supposed to be comfortable, aesthetic, and capable of adjusting the shape of a woman's breasts. Many women dislike the appearance and size of their breasts, especially when confronted with images showing what is regarded as an ideal. Not surprisingly, women desire to have a figure that matches the ideal, whether they perceive their breasts are too small or large.

Bra pads, molded cups and three dimension bra cups have been used to provide enhancement to small breasts. On the other hand, large breasts may cause self consciousness, discomfort or adversely affect posture and cause back ache. Breast surgery has been proposed and provides solution for particularly problematic cases. But this is a drastic solution and carries medical risks. Therefore, reinforced support bras have been developed but these bras create compression, pressure and confinement for the breasts, and there is emerging evidence that this may be harmful for the breasts.

Breast Health and Bras

Bras have been designed to provide comfort and address health issues. For example, bras intended to provide a massaging function or ventilation were described. The following are prior patents showing the state of the art that pertains partly to the invention at hand.

U.S. Pat. No. 5,944,578 to Lin et. al., describes a bra lining mounted in a bra and includes a sealed main body containing thick oil and gold foils therein. The oil flows inside the main body to provide a massaging effect while the gold foils increase magnetic energy around the breasts to activate the cells.

U.S. Pat. No. 6,921,316 to Jain, describes a bra body made of silicone rubber and includes a reinforcing rib, a rear member mounted to the inside of the body, and includes protrusions which are in contact with the breast for massaging the breast, while the gaps between the protrusions create ventilation.

U.S. Pat. No. 6,422,917 to Rose et. Al., describes a therapeutic bra constructed of a one piece directional elastic material, self forming cups and emanating from the apex of each cup shoulder straps that pass over the shoulder to the opposite side of the bra. The main purpose of the bra is to provide support for the breasts without constriction and to create a natural lift. Fasteners are placed at the lateral sides of the bra, which is a disadvantage, and this design does not provide adequate support in the cups and is prone to cause the bra to ride up.

For women who operate computers an electromagnetic wave proof cut structure for bra has been designed for protecting the breasts. For example, U.S. Pat. No. 6,814,647 to Huang, describes an electromagnetic wave proof cup structure for a bra including a first layer, a second layer and an intermediate layer joined to the first and the second layers. The intermediate layer contains metallic fiber so as to screen the electromagnetic wave and the contact area between the breast and the bra to reduce effects of electromagnetic waves.

October is the Breast Cancer Awareness month and in 2007, women of all ages and background advocated pitching their bras for health reasons. Needless to say, such action is likely to raise social issues and eyebrows. This is because there is a growing body of evidence that bra-wearing can have significant impact on breast health. In a study of 4500 women in five cities in the United States, it was found that women who wore a bra 24 hours a day had a 3 out of 4 (75%) chance of developing breast cancer. Women who wore a bra for more than twelve hours a day, but did not wear one to bed, had a one out of seven (14%) chance of developing breast cancer. Women who wore a bra less than twelve hours a day had a one in fifty two (2%) chance of developing breast cancer. Women who rarely wore a bra had a (0.6%) chance of developing breast cancer ("Dressed to Kill, ed. Sydney Ross Sinder and Soma Grismaijer). Several theories have been proposed to explain the link of increased risk of breast cancer and duration of wearing bras.

Tight fitting bras restrict and compress the lymphatic system in the breast. The Lymphatic system is responsible for flushing out bodily wastes and toxins and this could become impeded with compression. Thus the lymph nodes, acupressure points, and the circulatory pathways in the breast and arm pit areas, may be restricted and prevented from doing their job by tight fitting bras, and may result in toxins to accumulate in the breast tissue.

There is a mistaken belief that wearing a tight bra strengthens the breasts and prevents their eventual sagging because the sagging is related to the proportion of fat and tissue in the breast tissue and no bra can change that.

Bras can cause breasts to sag because chest muscles work less when breasts are supported and compressed in a bra and overtime the muscles and ligaments atrophy because of lack of use.

There is evidence that exercise may have a beneficial effect in reducing the risk for breast cancer. Women of all ages do isometric upper body exercises using weights just so to activate the chest, lateral and back muscles and firm up the breasts and strengthen the back, while reducing back pain. Many women report a decrease in headaches and neck pain after doing such exercises and/or reducing their bra-wearing time. Unfortunately, many women cannot incorporate an upper body exercise regimen in their daily routine. Furthermore, pitching the bras totally may not be an option for most, and reducing the bra-wearing time each day may not be practical, and even if practical, would continue the risk exposure during the bra-wearing time. A need exists for a bra that overcomes the disadvantages of the various bras described in the prior art. There is therefore a need for a bra with smart cups that allows the breasts to be projected, lifted up and supported by ergonomically constructed side and back support frame lying over the chest, lateral and back muscles in a non-restrictive, dynamic and naturally healthy way, while at the same time is aesthetically pleasing and has a modern silhouette.

The above disadvantages have been overcome in the present invention. The present invention relates to smart combo cups built into a sling of breast support and a wireless ergonomically designed bra that allows the breasts to be projected and lifted by a dynamic bra construction for the breasts to be supported by the chest, lateral and back muscles, and said ergonomic dynamic bra does not compress the lymphatic system but increases the lymphatic flow through interactive motion of the upper body. Importantly, the ergonomic dynamic bra with the smart combo cups of the present invention is not only aesthetically pleasing and naturally comfortable, but also fits the ideal image of any figure.

3. SUMMARY OF THE INVENTION

The ergonomic dynamic bra with the smart combo cups of the present invention is constructed to provide lift and projection for breasts of all sizes and to facilitate bilateral and cross over motion to allow continuous interaction between the free breasts and the chest, lateral and back muscles that provide support, motion and comfort.

The first embodiment of the invention, the smart combo cups, is constructed with a variety of materials and includes a plurality of strategically placed support elements to achieve maximum lift and projection of the breasts without using any pressure or hard metal or plastic under wires. Each smart combo cup comprises a plastic mesh shaped like a wide sling to achieve a soft and quiet bust point area, said wide sling is embedded between two layers of foam of varying thickness, and an adhesive foil to create the statics and physics needed, with the adhesive foil placed on top of a tear drop or any other shape such as circle or oval opening in the sling to connect the two foam layers in the bust point area. Each smart combo cup comprises a reinforced area that provides support and projection to the breast and ends on the side as a narrow cup inserting seam gently around the breast to allow joining the cup to the ergonomic dynamic bra portion without any wire forcing or pressing the smart cup in an unnatural position.

The cup inserting seam of the invention reaches further back under the arm pit than traditional cup seams, which makes it again unique because the cup inserting seam is designed to really embrace the true base line of a breast, and in turn allows the seam to sit in a natural unencumbered place and not on top of lymphatic system, acupressure points or mammary glands. In this position the smart combo cup responds to the body's movement and dynamically induces the stimulation of the breasts and its structural components such as the mammary glands, the lymphatic and nervous systems, the lymph nodes and the chest and lateral muscles, thus resulting in a naturally enhanced lift and projection as well as continuous motion and support to the breasts resulting in improved breast health and well being of a woman who is wearing the ergonomic dynamic bra regardless of the size of the breasts. The tear drop shaped or other shape such as circle or oval opening in the sling may extend from a medial portion of the smart combo cup to the soft and quiet bust point, and therefore creates a soft section in the nipple area.

In the second embodiment, the invention includes a strapless and/or semi-demi design of the ergonomic dynamic bra with smart combo cups built into a sling breast support, a one-piece support frame, a telescope boning and a V-shaped back strap base ending in a soft seal and cushion back fastener. The side of the frame area is supported by a unique bone system which prevents the side area from collapsing and the tissue at the side of the body from bulging. Specifically, overlapping bones are attached to the floating edge of the frame, and to the elastic trim at the bottom band and top back caught in the zig zag seam to hold it in place, while cushioned between the support frame material, a composition of softly laminated artificial rubber, and the outer elastic fabric. Sandwiched between side of the frame and the outer elastic fabric the telescope boning provides maximum comfort and adjusts intelligently to the movement of the body or different body types.

Generally, wireless bras have a conspicuously high center front area framed by the cups creating a matronly appearance. To achieve a desirable plunging neckline with inconspicuous cups, the smart combo cups of the present invention are constructed built in the breast sling using a combination of different materials to create the semi-demi ergonomic dynamic bra having a modern and feminine look and silhouette suitable for different shapes and needs. The strapless ergonomic bra is modified at the apex of each cup to provide support and anchor. The semi-demi ergonomic dynamic bra with the smart combo cups includes front straps emanating from the apex of the smart combo cups to the back strap base on the same side.

In a third embodiment, the invention includes a full coverage design of the ergonomic dynamic bra including the smart combo cups, a sling breast support, a support frame, a telescope boning, a horizontal back strap ending in a soft seal and cushion back fastener and a pressure releasing cushioned front strap, comprising an artificial rubber that prevents the strap to collapse or from digging in.

In a fourth embodiment, the invention includes a full coverage cross-over design of the ergonomic dynamic bra including the smart combo cups, a sling breast support, a support frame, a telescope boning, a V-shaped back strap base ending in a soft seal and cushion back fastener, a pressure releasing cushioned front strap with a unique strapping arrangement, for example, the front strap from the right cup crosses over the shoulder in the small of the back and is fastened to the left extended side of a tongue shaped back frame which is attached to the side of the support frame and leads through a self-adjusting fixture at the top back of the ergonomic dynamic bra. Similarly, the front strap from the left cup crosses over the shoulder in the small of the back and is fastened to the right side of a tongue shaped back frame which is attached to the side of the support frame of the ergonomic dynamic bra.

The invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth. The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying drawings in which preferred structural embodiments incorporating the principles of the present invention are shown by way of illustrative examples.

4. BRIEF DESCRIPTION OF FIGURES

A better understanding of the present invention may be obtained from the following detailed description of the preferred embodiments described in connection with the accompanying drawings wherein:

FIG. 1 illustrates a view of the cross section, showing the order of layers through the cut-out opening of the multi-layered smart combo cup including a 5 mm foam laminated on one side corresponding to the outside of the cup, a mesh with a cut-out-area to avoid a "plop sound" at the bust point and create a soft bust point environment, a fuse foil placed in the cut-out-area to fuse the 2 foam layers and a 3 mm foam laminated on one side, corresponding to the inside of the cup.

Figure 8:
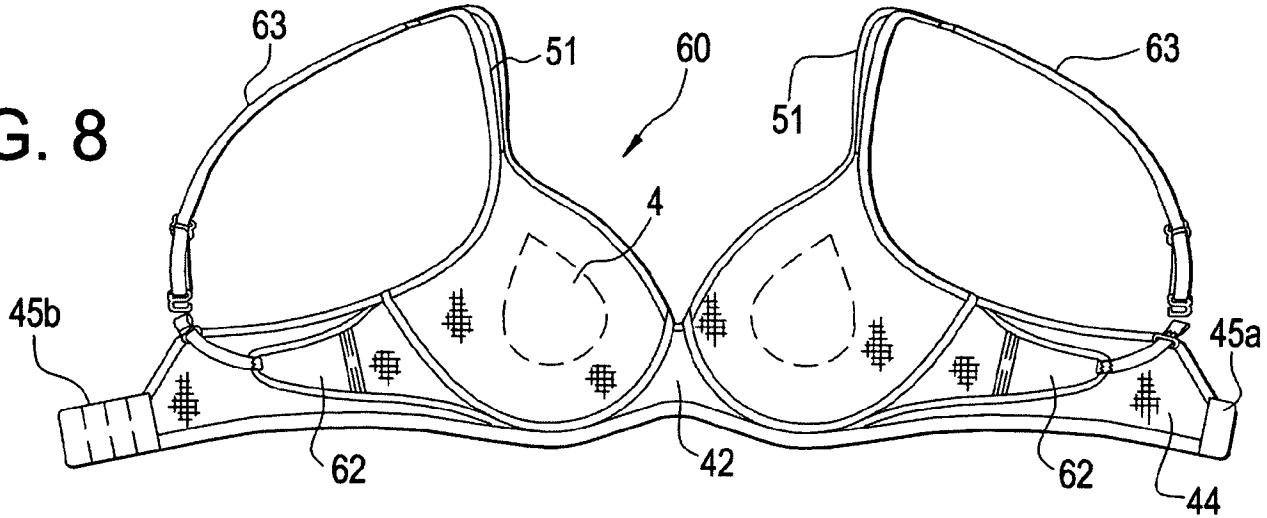

FIG. 8 illustrates the full coverage design of the ergonomic dynamic bra in a front view, including smart combo cups built in a sling breast support, a pair of telescope boning, a support frame, a pair of back strap ending in a soft seal and cushion back fastener, and a pair of pressure releasing cushioned front straps that cross over their respective shoulders in the small of the back and attach to the opposite extended side of a tongue shaped frame which is attached to the side of the support frame.

Figure 9:
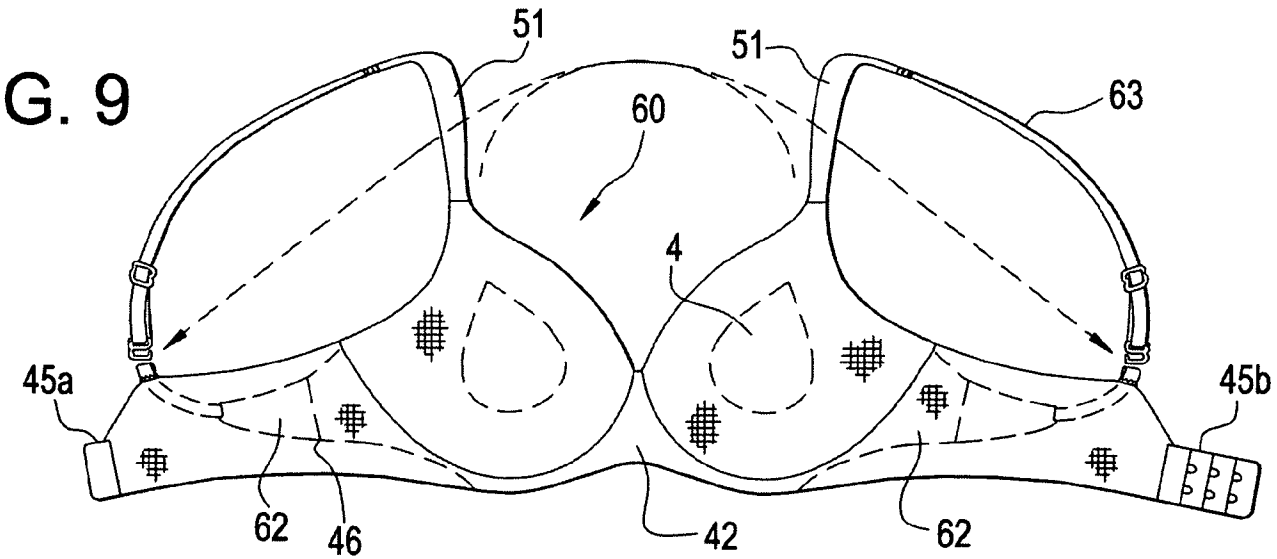

FIG. 9 illustrates the full coverage design of the ergonomic dynamic bra in a front view of FIG. 8 with parts broken away for clarity.

5. DETAILED DESCRIPTION OF THE INVENTION

The present invention will now be described more fully hereinafter with reference to the accompanying drawings, in which preferred embodiments of the invention are shown. The invention may however, be embodied in many different forms and should not be construed as limited to the embodiments set forth herein. Rather, these embodiments are provided so that this disclosure will be thorough and complete, and fully convey the scope of the invention to those skilled in the art. Like numbers refer to like elements throughout.

The term "ergonomic" as used herein represents the object of designing and constructing the smart combo cups built into a breast sling and bra to support and maximize motion and activity by reducing the wearer's fatigue and discomfort and creating support for the breasts, which in turn reduces pressure on the diaphragm.

The term "combo" as used herein represents the unique design and construction of the bra cup comprising support elements and different materials and carvings that give the cup a natural shape with a modern silhouette.

The term "dynamic" as used herein relates to the continuous activity of the breasts in relation to body motion and involves an interactive process between the breasts and the various muscle systems, including the chest muscles, the diaphragm, lateral muscles and back muscles. The chest muscles include, but are not limited to the pectoralis major, intercoastal and the serratus anterior. The lateral muscles include, but are not limited to the external obliques, the latisimus dorsi. The back muscles include, but are not limited to the trapezius, the rhomboid major and rhomboid minor.

This invention discloses an ergonomically constructed dynamic bra including smart combo cups to provide lift and projection naturally to the breast without causing compression, pressure or confinement and without use of under wires. More particularly, the first embodiment relates to smart combo cups designed with multilayered materials and cut to create a modern neckline silhouette, supporting underarm and a cut-out tear drop, or any other shape, such as circle or oval section in the bust point area, each of said smart combo cups built into a dynamic sling breast support.

The first embodiment of the invention, the smart combo cups, is constructed with a variety of materials and includes a plurality of strategically placed support elements to achieve maximum lift and projection of the breasts without using any pressure or hard metal or plastic under wires. Each smart combo cup comprises a plastic mesh shaped like a wide sling to achieve a soft and quiet bust point area, said wide sling is embedded between two layers of foam of varying thickness, and an adhesive foil to create the statics and physics needed, with the adhesive foil placed on top of a tear drop or any other shape shaped opening in the sling to connect the two foam layers in the bust point area. Each smart combo cup comprises a reinforced area that provides support and projection to the breast and ends on the side as a narrow seam gently around the base of the breast to allow joining the cup to the ergonomic dynamic bra portion without any wire forcing or pressing the smart combo cup in an unnatural position. In this position the smart combo cup responds to the body's movement and dynamically induces the stimulation of the breasts and its structural components such as the mammary glands, acupressure points, the lymphatic and nervous systems, the lymph nodes and the chest and lateral muscles, thus resulting in a naturally enhanced lift and projection as well as continuous motion and support to the breasts resulting in improved breast health and well being of a woman who is wearing the ergonomic dynamic bra regardless of the size of the breasts. The tear drop, or any other shape such as circle or oval shaped opening in the sling may extend from a medial portion of the smart combo cup to the quiet and soft bust point in the nipple area, more particularly, the combination of foam without the mesh that makes the bust point softer.

A multilayer brassiere cup structure for inclusion in a finished brassiere comprising: a first foam layer having an inner surface and an outer surface; a first fabric layer laminated to said outer surface of said first foam layer thereby forming a first foam and fabric laminate; said first foam layer having a thickness in the range of 2 mm to 10 mm; a second layer of mesh material from which is cut a portion in the form of any one of a tear drop, a circle or an oval shape to thereby leave an opening wherein which is covered by a fuse foil; a third foam layer having an inner surface and an outer surface with a fabric layer laminated to said outer surface of said third foam layer thereby forming a third foam and fabric laminate; said third foam layer having a thickness in the range of 2 mm to 10 mm; said first foam and fabric laminate molded to said third foam and fabric laminate with said second layer of said mesh material and fuse foil there between to thereby form said multilayer brassiere cup structure wherein when molded said inner surface of said first foam layer lies over said mesh and fuse foil layer and faces said inner surface of said third foam layer; said opening covered with fuse foil is located in said second layer of mesh material to thereby lie over a bust point of said brassiere cup structure and wherein said multilayer brassiere cup structure has an outer periphery with an apex for connection with a shoulder strap of a finished brassiere, a top edge portion that lies along a neckline area within a finished brassiere, a lateral edge portion that lies along an underarm area in a finished brassiere that then connects to said apex; and a lower curved edge portion that joins said top edge portion to said lateral edge portion; said lower curved edge portion connects with a support panel portion in a finished brassiere.

A multilayer brassiere cup structure for inclusion in a finished brassiere includes the first foam layer with a thickness of 3 mm or 5 m thick.

Another embodiment of a brassiere includes a multilayer molded and laminated brassiere cup structure, in combination, comprising: a pair of molded and laminated brassiere cups with each brassiere cup including:

a first foam layer having an inner surface and an outer surface; first fabric layer laminated to said outer surface of said first foam layer thereby forming a first foam and fabric laminate; said first foam layer having a thickness in the range of 2 mm to 10 mm; a second layer of mesh material from which is cut a portion in the form of any one of a tear drop, a circle or an oval shape to thereby leave an opening therein which is covered by a fuse foil; a third foam layer having an inner surface and an outer surface with a fabric layer laminated to said outer surface of said third foam layer thereby forming a third foam and fabric laminate; said third foam layer having a thickness in the range of 2 mm to 10 mm; said first foam and fabric laminate molded to said third foam and fabric laminate with said second layer of said mesh material and fuse foil there between to thereby form said multilayer brassiere cups wherein when molded said inner surface of said first foam layer lies over said mesh and fuse foil layer and faces said inner surface of said third foam layer; said opening covered with fuse foil is located in said second layer of mesh material to thereby lie over a bust point of each said brassiere cup and wherein each said multilayer brassiere cup has an outer periphery with an apex for connection with a shoulder strap of said brassiere, a top edge portion that lies along a neckline area within said brassiere, a lateral edge portion that lies along an underarm area in said brassiere that then connects to said apex; and a lower curved edge portion that joins said top edge portion to said lateral edge portion; said lower curved edge portion connects with a support panel portion in said brassiere; a support frame that extends under, along side and between the two brassiere cups and is attached thereto; a pair of back strap wings with each back strap wing having a first end attached to and extending from a lateral side edge of each multilayer molded cup and a second end attached to a fastener component wherein each of said fastener components when connected form a rear closure on the brassiere; a pair of shoulder straps with each shoulder strap having a first end attached to and extending from an apex of each of the multilayer molded cups and a second end attached to each of said back strap wings; and boning extending vertically between said support frame at each side support frame end and each of said back wings. Another embodiment of a brassiere includes a multilayer molded and laminated brassiere cup structure wherein the first foam layer is 3 mm or 5 m thick; and the fastener is a soft seal cushion hook and eye arrangement. The brassiere includes a sling having a first end and a second end, wherein the first end is connected to the lateral side of each cup and the second end that is tongue shaped is attached to the brassiere back wing. The brassiere also includes a first cushioned shoulder strap attached to a first brassiere cup and a second cushioned shoulder strap attached to a second brassiere cup, each cushioned shoulder strap crossing over the shoulder in the small of the wearer's back and joined to the opposite side to a tongue shaped back frame.

Figure 1:
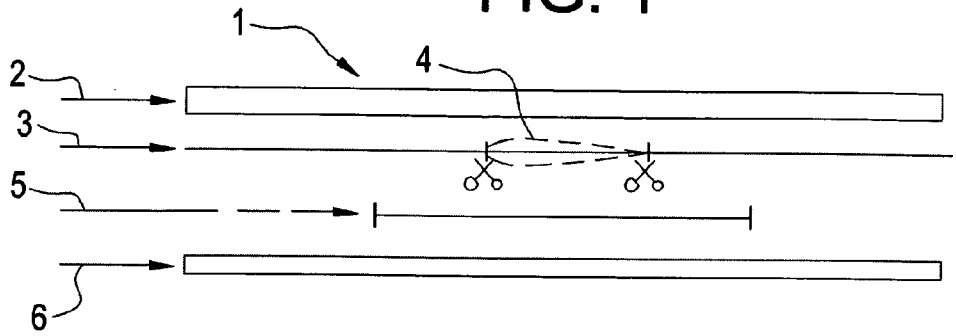

FIG. 1 shows the order of the layers as a cross section view designated 1 of the smart combo cup comprising an upper layer 2 with a thickness ranging from 2 mm to 10 mm, and preferably of 5 mm foam that is laminated on one side, a second layer 3 of a mesh material having a cut-out-area 4 designed to avoid a plop-sound at the bust point and therefore create a soft area, a third layer 5 of fuse foil placed in the cut-out-area 4 to fuse the upper layer of foam 2 with a thickness ranging from 2 mm to 10 mm, preferably 3 mm foam layer 6, placed beneath the fuse foil 5. Each of the foam layers 2 or 6 is laminated on one side and may comprise of a moldable foam quality and a soft moldable lamination fabric.

Figure 2:
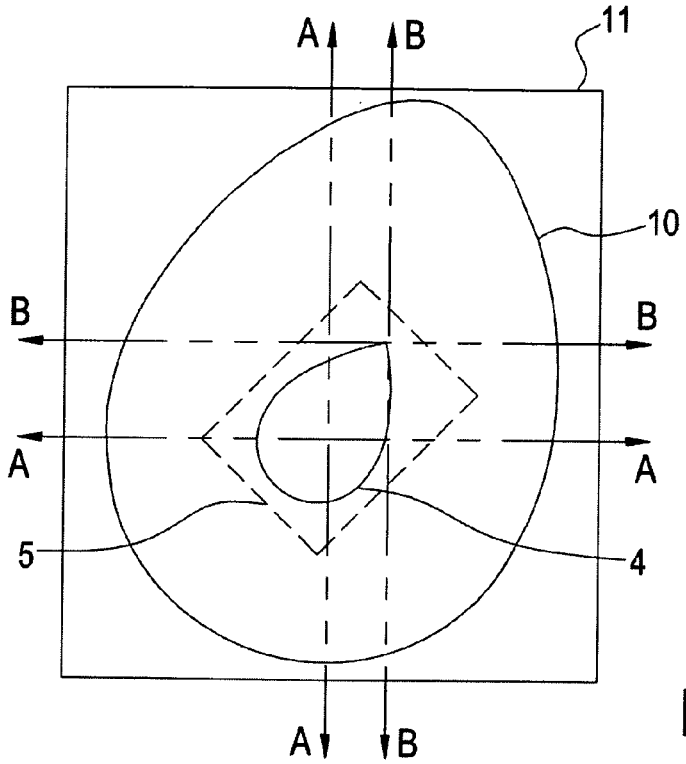
FIG. 2 illustrates the placement of the smart combo cup in a molding machine including the 5 mm foam facing down and the mold outlines based on the shape of a mother mold base.

FIG. 2 illustrates the mother mold base 10 of the smart combo cup in its placement in the molding machine within a mold frame 11 with the upper foam layer 2 face down and forming the outside of the smart combo cup, the cut-out-area 4 and the fuse foil 5 covering the cut-out-area 4. A-A represents a cross-sectional representation of the mother mold center and B-B represents the top position of the cut-out-area 4. AA and BB represent the placement of in this case a tear drop shaped cut out section, very important for the correct and strategic positioning during the molding preparations. The combo cup shape is cut or carved out with a cutting tool similar to a cookie cutter, after the molded layers have cooled down in a special frame.

Figure 3:
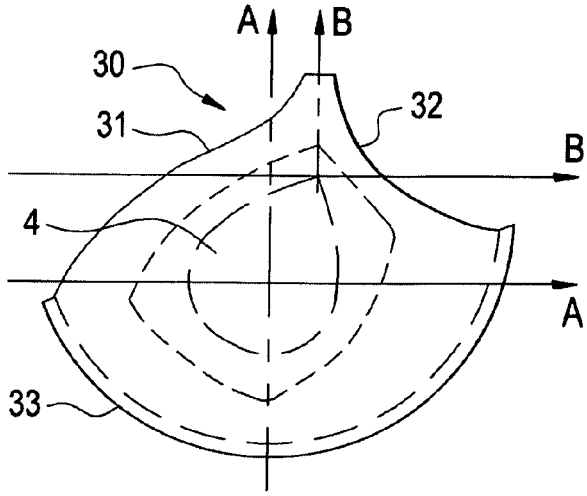
FIG. 3 illustrates the position of the finished smart combo cup including the neckline, the under arm, the cup inserting seam extended in an angel as a lip and a cut-out bust point area including mesh and foil.

FIG. 3 illustrates the finished smart combo cup 30 which comprises a modern looking silhouette of a deep neckline 31, a carefully carved out underarm portion 32 to prevent breast overflow or dig into the soft tissue in this area, a cup inserting portion with an extended lip 33 and a cut-out-area 4 in the bust point area.

The second embodiment includes a semi-demi ergonomic bra design with a plunging neckline and including at the sides telescope boning, support frame and back strap ending in a soft-seal and cushioned back fastener.

In the second embodiment, the invention includes a semi-demi design of the ergonomic dynamic bra with smart combo cups built into a sling breast support, a one-piece support frame, a telescope boning and a V-shaped back strap base ending in a soft seal and cushion back fastener. The side of the frame area is supported by a unique bone system which prevents the side area from collapsing and the tissue at the side of the body from bulging. Specifically overlapping bones are attached to the floating edge of the frame, and to the elastic trim at the bottom band and top back caught in the zig zag seam to hold it in place, while cushioned between the support frame material, a composition of softly laminated artificial rubber, and the outer elastic fabric. Sandwiched between side of the frame and the outer elastic fabric the telescope boning provides maximum comfort and adjusts intelligently to the movement of the body or different body types.

Generally, wireless bras have a conspicuously high center front area framed by the cups creating a matronly appearance. To achieve a desirable plunging neckline with inconspicuous cups, the smart combo cups of the present invention are constructed built in the breast sling using a combination of different materials to create the semi-demi ergonomic dynamic bra having a modern and feminine look and silhouette suitable for different shapes and needs. The semi-demi ergonomic dynamic bra with the smart combo cups may be strapless or may include front straps emanating from the apex of the smart combo cups to the back strap base on the same side.

Figure 4:
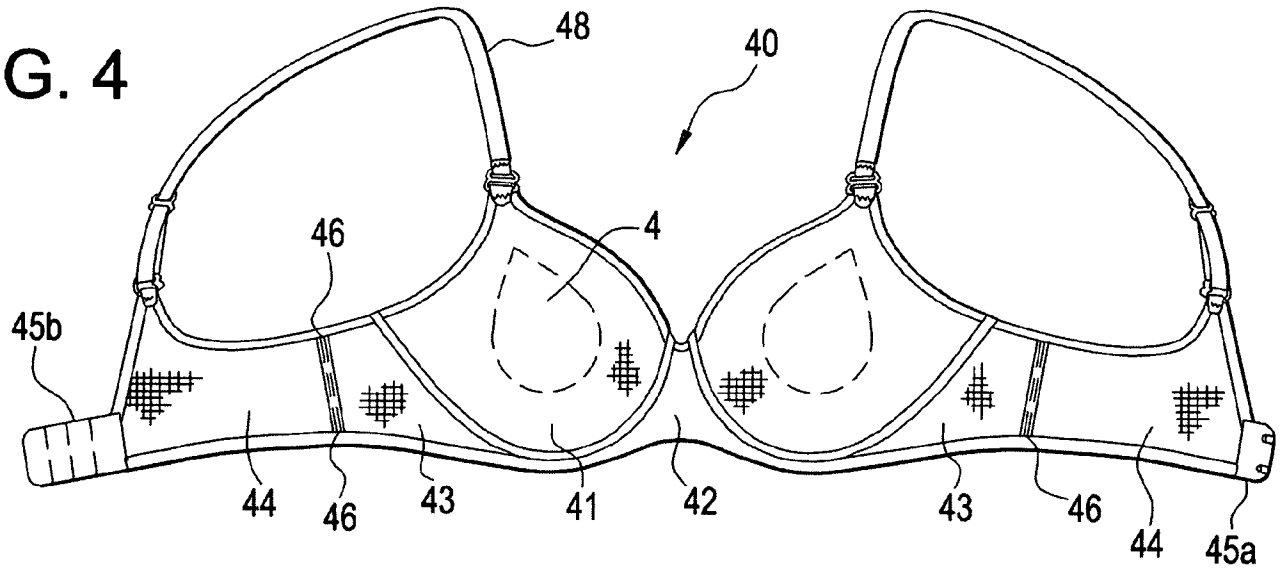
FIG. 4 illustrates the semi-demi design of the ergonomic dynamic bra in a front view, including smart combo cups built in a sling breast support, a pair of telescope boning, a support frame, a pair of back strap and a soft seal and cushion back fastener.
Figure 5:
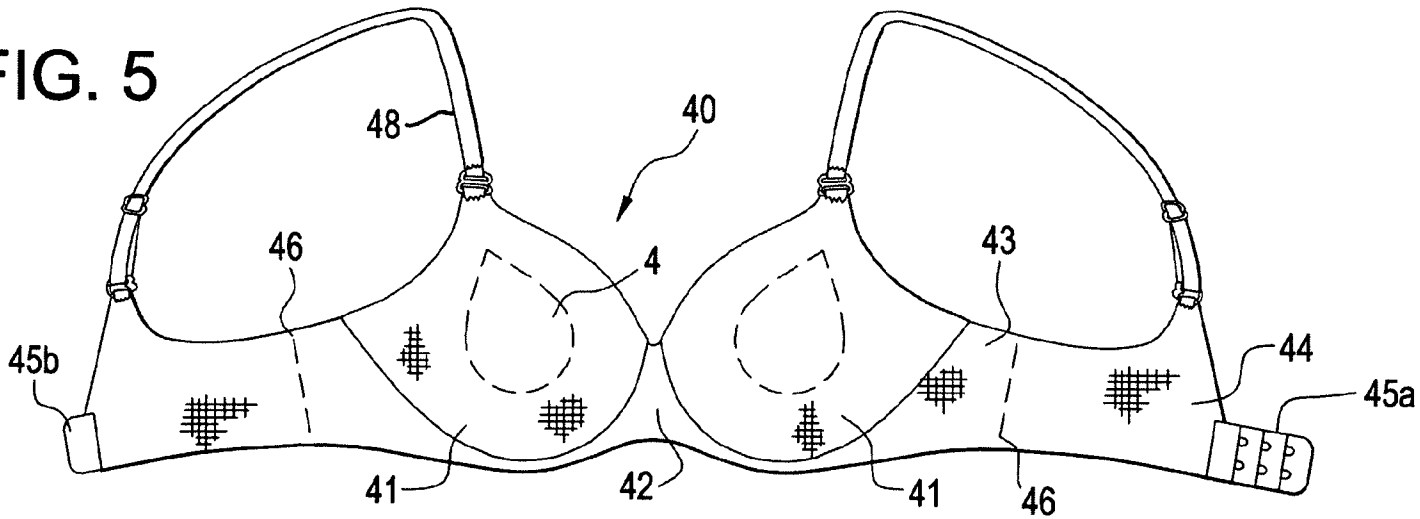
FIG. 5 illustrates the semi-demi design of the ergonomic dynamic bra in a front view of FIG. 4 with parts broken away for clarity.

FIG. 4 and FIG. 5 illustrate the semi-demi pattern of an ergonomic dynamic bra 40 when laid out flat and as it would be seen from the front by a viewer standing in front of the model. All other views in subsequent drawings should be viewed in the same manner.

FIG. 4 illustrated the semi-demi design of the ergonomic bra 40 with smart combo cups 41 built into a sling breast support comprising support panel portion 42 in between the two smart cups 41, said panel portion 42 may be optionally part of a one-piece support frame 43 embedding each one of the smart combo cups 41, and a V-shaped back strap base 44 ending in a soft seal and cushion back fastener 45*a* and 45*b*. The floating sides of the support frame 43 and the elastic back wing 44 are joined only at the top back and bottom band covered with soft elastic trimming. The telescope boning 46 is located sandwiched between those 2 layers and provides maximum comfort and excellent performance during body motion or adjusts perfectly to each body type. The telescope boning is attached to the elastic trimmings at the bottom band 47 and top back forming a lower and upper border for the entire bra, thereby ensuring that the bra does not collapse while at the same time preventing the bulging of the breast tissue on the side below the arm pits. In the semi-demi design of the ergonomic dynamic bra with the combo cups, a pair of front straps 48, each emanates from the apex of each smart combo cup and join the back strap on the same side. The design of a strapless ergonomic bra is similar except that it does not have straps but instead, the apex of each cup is modified to provide support and anchor.

FIG. 5 shows the front view of the ergonomic dynamic bra 40 with the smart combo cups with parts broken away for clarity.

The third embodiment includes a full coverage ergonomic dynamic bra designed having more coverage, and a wider shoulder strap platform compared to the semi-demi bra, but including in addition a pair of pressure releasing cushioned front straps, but including in addition a pair of pressure releasing cushioned front straps. The invention includes a full coverage design of the ergonomic dynamic bra including the smart combo cups, a sling breast support, a support frame, a telescope boning, a V-shaped back strap base ending in a soft seal and cushion back fastener and a pressure releasing cushioned front strap.

Figure 6:
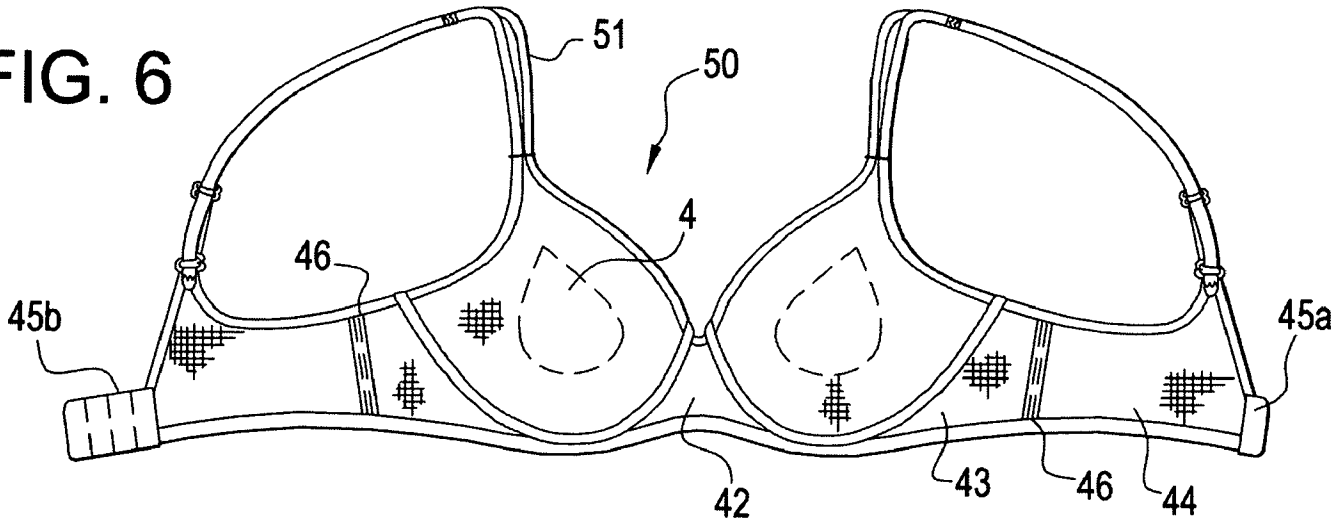
FIG. 6 illustrates the full coverage design of the ergonomic dynamic bra in a front view, including smart combo cups built in a sling breast support, a pair of telescope boning, a support frame, a pair of back strap ending in a soft seal and cushion back fastener, and a pair of pressure releasing cushioned front straps.
Figure 7:
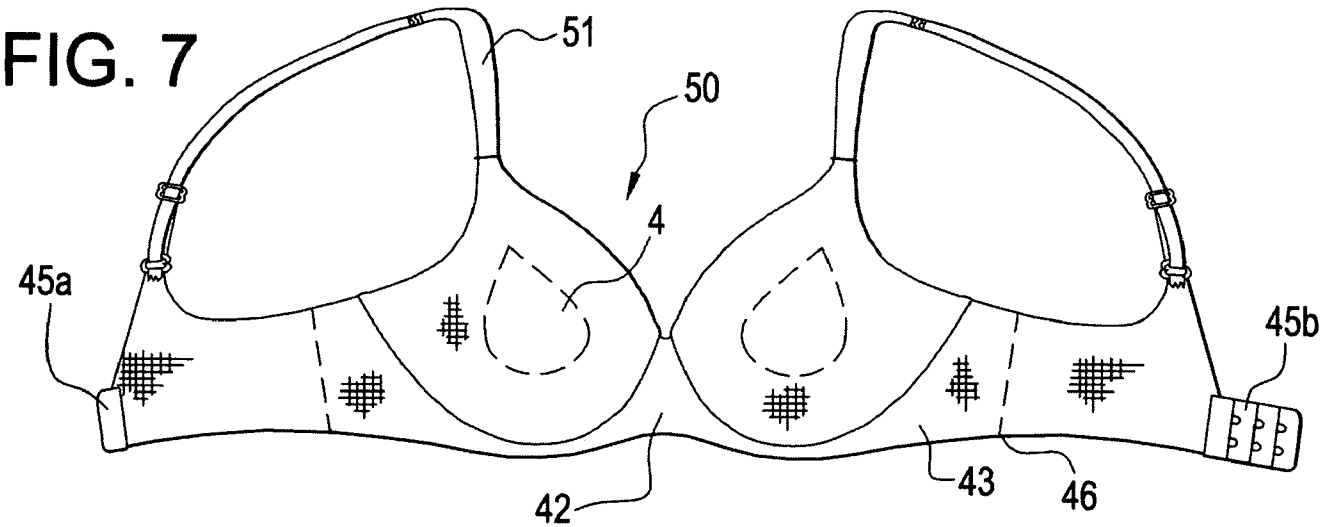
FIG. 7 illustrates the full coverage design of the ergonomic dynamic bra in a front view of FIG. 6 with parts broken away for clarity.

FIG. 6 and FIG. 7 illustrate the full coverage pattern of an ergonomic dynamic bra 50 when laid out flat and as it would be seen from the front by a viewer standing in front of the model. All other views in subsequent drawings should be viewed in the same manner.

FIG. 6 illustrated the full coverage design of the ergonomic bra 50 with smart combo cups 41 built into a sling breast support comprising support panel portion 42 in between the two smart cups 41, said panel portion 42 may be optionally part of a one-piece support frame 43 embedding each one of the smart combo cups 41, and a V-shaped back strap base 44 ending in a soft seal and cushion back fastener 45*a* and 45*b*. The floating sides of the support frame 43 and the elastic back wing 44 are joined only at the top back and bottom band covered with soft elastic trimming. The telescope boning 46 is located sandwiched between those 2 layers and provides maximum comfort and excellent performance during body motion or adjusts perfectly to each body type. The telescope boning is attached to the elastic trimmings at the bottom band 47 and top back forming a lower and upper border for the entire bra, thereby ensuring that the bra does not collapse while at the same time preventing the bulging of the breast tissue on the side below the arm pits. A pressure releasing cushioned front strap 51 emanates from the apex of the smart combo cup and extends over the shoulder on the same side to be joined to the back strap.

FIG. 7 shows the front view of the ergonomic dynamic bra 50 with the combo of smart cups with parts broken away for clarity.

The fourth embodiment includes an ergonomic dynamic full coverage design of the ergonomic dynamic bra in a front view, including smart combo cups built in a sling breast support, a pair of telescope boning, a support frame, a pair of back strap ending in a soft seal and cushion back fastener, and a pair of pressure releasing cushioned front straps that cross over their respective shoulders in the small of the back and attach to the opposite extended side of the frame and back strap base.

The invention includes a full coverage cross-over design of the ergonomic dynamic bra including the smart combo cups, a sling breast support, a support frame, a telescope boning, a back strap base attached to the extended side of the support frame shaped like a tongue ending in a soft seal and cushion back fastener, a pressure releasing cushioned front strap with a unique strapping arrangement, for example, the front strap from the right cup crosses over the shoulder in the small of the back and is fastened to the left back strap attached to the extended side of the frame and hold in position through a self adjusting fixture of the ergonomic dynamic bra. Similarly, the front strap from the left cup crosses over the shoulder in the small of the back and is fastened to the right side of the back strap same as above, of the ergonomic dynamic bra.

FIG. 8 and FIG. 9 illustrate the full coverage cross-over pattern of an ergonomic dynamic bra 60 when laid out flat and as it would be seen from the front by a viewer standing in front of the model. All other views in subsequent drawings should be viewed in the same manner.

FIG. 8 illustrated the full coverage cross-over design of the ergonomic bra 50 with smart combo cups 41 built into a sling breast support comprising support panel portion 42 in between the two smart cups 41, a one-piece support frame 43 embedding the smart combo cups 41, and a back strap base 44 ending in a soft seal and cushion back fastener 45*a* and 45*b*. A pair of pressure releasing cushioned front straps 51 that cross over their respective shoulders in the small of the back and is attached to the opposite extended side of the support frame shaped like a tongue 62 which in turn is attached to the side support frame 43.

The support frame 43 is one piece and the side of the support frame is floating underneath an outer elastic fabric from the bottom of the cup inserting seam 33. The telescope boning is placed between the outer elastic fabric 44 and the support frame material 43 and only attached to the extended tongue shaped support back frame 62 which in turn is attached to the side frame 43. The pressure releasing cushioned front strap 51 emanates from the apex of the smart cup, extends across the shoulder on the opposite side, cross in the small of the back and are joined to the back strap 62 on the side opposite.

FIG. 9 shows the front view of the full coverage cross-over design of ergonomic dynamic bra 60 with the smart combo cups with parts broken away for clarity.

A conventional commercially available molding and stitching programmable machine must be used to prepare the embodiments of the invention. The stitching selection and the materials employed are adjusted to provide varying support in the required parts of the garment of the present invention. The material used in the preparation of the various designs of ergonomic dynamic bra with smart combo cups garments can be selected from commercially available materials. The foam may include various thicknesses and laminated fabric qualities. Various necklines can be designed including, but not limited to V-neck, sweet heart. The garments of the invention may be worn stand alone or as undergarments. The garments of the present invention are made of foam that may be breathable or not, that would be the future working on a spacer cup and the stitching selections used yield breathability and ventilation when needed. The ergonomic dynamic bras of the invention are seamless, in particular in the bust point area, creating a maximum on sleekness under outer wear clothes and provide variable support and comfort to the busts and the upper body thus improving the overall conditions around the breast environment.

The present invention is not to be limited in scope by the embodiment disclosed in the example which is intended as an illustration of one aspect of the invention and any methods which are functionally equivalent are within the scope of the invention. Indeed, various modifications of the invention in addition to those shown and described herein will become apparent to those skilled in the art from the foregoing description. Such modifications are intended to fall within the scope of the appended claims. It is realized that other variations and modifications of the preferred embodiment are possible without departing from the scope and spirit of the present invention. Those skilled in the art will recognize, or be able to ascertain using no more than routine experimentation, any equivalents to the embodiments described herein. Such equivalents are intended to be encompassed by the claims.

What is claimed is:

1. A multilayer brassiere cup structure for inclusion in a finished brassiere comprising:

a first foam layer having an inner surface and an outer surface;

a first fabric layer laminated to said outer surface of said first foam layer thereby forming a first foam and fabric laminate;

said first foam layer having a thickness in the range of 2 mm to 10 mm;

a second layer of mesh material from which is cut a portion in the form of any one of a tear drop, a circle or an oval shape to thereby leave an opening wherein which is covered by a fuse foil;

a third foam layer having an inner surface and an outer surface with a fabric layer laminated to said outer surface of said third foam layer thereby forming a third foam and fabric laminate;

said third foam layer having a thickness in the range of 2 mm to 10 mm;

said first foam and fabric laminate molded to said third foam and fabric laminate with said second layer of said mesh material and fuse foil there between to thereby form said multilayer brassiere cup structure wherein when molded said inner surface of said first foam layer lies over said mesh and fuse foil layer and faces said inner surface of said third foam layer;

said opening covered with fuse foil is located in said second layer of mesh material to thereby lie over a bust point of said brassiere cup structure and wherein said multilayer brassiere cup structure has an outer periphery with an apex for connection with a shoulder strap of a finished brassiere, a top edge portion that lies along a neckline area within a finished brassiere, a lateral edge portion that lies along an underarm area in a finished brassiere that then connects to said apex;

and a lower curved edge portion that joins said top edge portion to said lateral edge portion;

said lower curved edge portion connects with a support panel portion in a finished brassiere.

2. A multilayer brassiere cup structure for inclusion in a finished brassiere as claimed in claim 1, wherein the first foam layer is 5 m thick.

3. A multilayer brassiere cup structure for inclusion in a finished brassiere as claimed in claim 1 wherein the first foam layer is 3 m thick.

4. A brassiere including a multilayer molded and laminated brassiere cup structure, in combination, comprising:

a pair of molded and laminated brassiere cups with each brassiere cup including:

a first foam layer having an inner surface and an outer surface;

a first fabric layer laminated to said outer surface of said first foam layer thereby forming a first foam and fabric laminate;

said first foam layer having a thickness in the range of 2 mm to 10 mm;

a second layer of mesh material from which is cut a portion in the form of any one of a tear drop, a circle or an oval shape to thereby leave an opening therein which is covered by a fuse foil;

a third foam layer having an inner surface and an outer surface with a fabric layer laminated to said outer surface of said third foam layer thereby forming a third foam and fabric laminate;

said third foam layer having a thickness in the range of 2 mm to 10 mm;

said first foam and fabric laminate molded to said third foam and fabric laminate with said second layer of said mesh material and fuse foil there between to thereby form said multilayer brassiere cups wherein when molded said inner surface of said first foam layer lies over said mesh and fuse foil layer and faces said inner surface of said third foam layer;

said opening covered with fuse foil is located in said second layer of mesh material to thereby lie over a bust point of each said brassiere cup and wherein each said multilayer brassiere cup has an outer periphery with an apex for connection with a shoulder strap of said brassiere, a top edge portion that lies along a neckline area within said brassiere, a lateral edge portion that lies along an underarm area in said brassiere that then connects to said apex;

and a lower curved edge portion that joins said top edge portion to said lateral edge portion;

said lower curved edge portion connects with a support panel portion in said brassiere;

a support frame that extends under, along side and between the two brassiere cups and is attached thereto;

a pair of back strap wings with each back strap wing having a first end attached to and extending from a lateral side edge of each multilayer molded cup and a second end attached to a fastener component wherein each of said fastener components when connected form a rear closure on the brassiere;

a pair of shoulder straps with each shoulder strap having a first end attached to and extending from an apex of each of the multilayer molded cups and a second end attached to each of said back strap wings;

and boning extending vertically between said support frame at each side support frame end and each of said back wings.

5. A brassiere including a multilayer molded and laminated brassiere cup structure, in combination as claimed in claim 4, wherein the first foam layer is 5 m thick.

6. A brassiere including a multilayer molded and laminated brassiere cup structure, in combination as claimed in claim 4, wherein the first foam layer is 3 m thick.

7. A brassiere including a multilayer molded and laminated brassiere cup structure, in combination as claimed in claim 4, wherein said fastener is a soft seal cushion hook and eye arrangement.

8. A brassiere including a multilayer molded and laminated brassiere cup structure, in combination as claimed in claim 4, wherein each of said molded and laminated cups is in a full coverage cup shape.

9. A brassiere including a multilayer molded and laminated brassiere cup structure, in combination as claimed in claim 4, wherein each of said molded and laminated cups is in a semi demi cup coverage shape.

10. A brassiere including a multilayer molded and laminated brassiere cup structure, in combination as claimed in claim 4, further comprising a sling having a first end and a second end, wherein the first end is connected to the lateral side of each cup and the second end that is tongue shaped is attached to the brassiere back wing.

11. A brassiere including a multilayer molded and laminated brassiere cup structure, in combination as claimed in claim 4, further comprising a first cushioned shoulder strap attached to a first brassiere cup and a second cushioned shoulder strap attached to a second brassiere cup, each cushioned shoulder strap crossing over the shoulder in the small of the wearer's back and joined to the opposite side to a tongue shaped back frame.

* * * * *